US011761625B2

(12) United States Patent
Allam et al.

(10) Patent No.: US 11,761,625 B2
(45) Date of Patent: Sep. 19, 2023

(54) HEAT GENERATION FOR SEPARATE ENDOTHERMIC PROCESS WITH CARBON CAPTURE

(71) Applicant: 8 Rivers Capital, LLC, Durham, NC (US)

(72) Inventors: Rodney John Allam, Wiltshire (GB); Glenn William Brown, Jr., Durham, NC (US)

(73) Assignee: 8 Rivers Capital, LLC, Durham, NC (US)

( * ) Notice: Subject to any disclaimer, the term of this patent is extended or adjusted under 35 U.S.C. 154(b) by 0 days.

(21) Appl. No.: 17/990,415

(22) Filed: Nov. 18, 2022

(65) Prior Publication Data

US 2023/0151960 A1 May 18, 2023

Related U.S. Application Data

(60) Provisional application No. 63/280,822, filed on Nov. 18, 2021.

(51) Int. Cl.
*F23G 7/06* (2006.01)
*F23L 7/00* (2006.01)

(52) U.S. Cl.
CPC ..... *F23G 7/066* (2013.01); *F23L 7/007* (2013.01); *F23G 2201/60* (2013.01); *F23G 2206/20* (2013.01); *F23G 2209/14* (2013.01); *F23L 2900/07005* (2013.01)

(58) Field of Classification Search
CPC .. F23G 7/066; F23G 2201/60; F23G 2206/20; F23G 2209/14; F23L 7/007; F23L 2900/07005; F23C 9/00; F23C 2202/00; F23C 2700/043; B01D 2256/22; B01D 2257/80; B01D 2313/00; B01D 2313/221; B01D 2315/22; B01J 19/1893
See application file for complete search history.

(56) References Cited

U.S. PATENT DOCUMENTS

2003/0068260 A1* 4/2003 Wellington ..... B01J 8/009 422/600
2010/0263377 A1 10/2010 Meulenberg et al.
2011/0094105 A1 4/2011 Tatsumi et al.
2012/0144837 A1 6/2012 Rasmussen et al.
2013/0236840 A1* 9/2013 Maslov ..... F23N 5/003 431/11
2022/0001326 A1* 1/2022 Serra Alfaro ..... F02C 3/20

FOREIGN PATENT DOCUMENTS

EP 3 336 430 A1 * 6/2018 ..... C03B 5/237

* cited by examiner

*Primary Examiner* — Timothy C Vanoy
(74) *Attorney, Agent, or Firm* — Womble Bond Dickinson (US) LLP

(57) ABSTRACT

A method for transferring thermal energy to a separate endothermic process includes: (a) providing a carbon dioxide ($CO_2$) stream and a carbonaceous fuel to a heater; (b) reacting the carbonaceous fuel in the heater to produce a heated stream; (c) transferring heat from the heated stream to the separate endothermic process; (d) separating the $CO_2$ stream from the heated stream after (c); and (e) recycling the $CO_2$ stream to the heater after (d).

20 Claims, 2 Drawing Sheets

HEAT GENERATION FOR SEPARATE ENDOTHERMIC PROCESS WITH CARBON CAPTURE

CROSS-REFERENCE TO RELATED APPLICATIONS

This application claims the benefit of U.S. Provisional Patent Application No. 63/280,822 filed Nov. 18, 2021, and entitled "Oxy Fuel Heating With Carbon Capture," the contents of which are incorporated herein by reference in their entirety.

BACKGROUND

Endothermic processes are driven by heat energy that is transferred to the process from an outside source. Such endothermic processes are commonplace in various industries, and some examples include ethylene production from naphtha and ethane cracking, hydrogen and carbon monoxide production by steam and hydrocarbon catalytic reforming, oil refinery processes, the production of styrene (e.g., via dehydrogenation or ethyl-benzene), metallurgical heat treatment processes, and steam production (e.g., in the context of electric power generation).

The heat source for an endothermic process may be derived from the combustion of a carbonaceous fuel, such as a hydrocarbon (e.g., diesel, gasoline, natural gas, etc.). However, such a process emits carbon dioxide ($CO_2$), which is increasingly becoming undesirable as societies worldwide attempt to move toward reduced-carbon, carbon-neutral, or carbon-negative operations.

BRIEF SUMMARY

The embodiments disclosed herein are directed to systems and methods for generating thermal energy to drive or power an endothermic process while also capturing carbon (e.g., in the form of $CO_2$) that is produced to reduce net carbon emissions during operations. In some embodiments, the systems and methods described herein may be utilized to capture carbon that is produced from the oxidation (including combustion) of a carbonaceous fuel, such as a natural gas. Thus, through use of the embodiments disclosed herein, thermal energy may be provided to an endothermic process without a corresponding increase in the output of $CO_2$ to the atmosphere.

Some embodiments disclosed herein are directed to a method of transferring thermal energy to a separate endothermic process. In an embodiment, the method includes (a) providing a $CO_2$ stream and a carbonaceous fuel to a heater, and (b) reacting the carbonaceous fuel with an oxidant in the heater to produce a heated stream. In addition, the method can include (c) transferring heat from the heated stream to the separate endothermic process, (d) separating the $CO_2$ stream from the heated stream after (c), and (e) recycling the $CO_2$ stream to the heater after (d).

As used herein, a "heater" is intended to reference any unit that is operable under conditions so that a fuel material that passed through the heater can undergo a reaction effective to at least partially oxidize the fuel material and release heat. The oxidation reaction is intended to expressly include partial or complete combustion of the fuel as well as oxidation of the fuel without combustion (e.g., reaction below the auto-ignition temperature of the fuel). The heater may be configured to achieve auto-combustion or auto-oxidation, such as may be experienced by passing the fuel material through a heater include one or more catalytic materials effective to at least partially oxidize, substantially completely oxidize, at least partially combust, or substantially completely combust the curl material. Likewise, the term "reacting" can indicate that the fuel has at least partially oxidized, substantially completely oxidized, at least partially combusted, or substantially completely combusted.

In some embodiments, the method includes (a) producing a $CO_2$ stream from a first outlet of a separator, (b) flowing the $CO_2$ stream to a heater, and (c) reacting a carbonaceous fuel with an oxidant in the presence of the $CO_2$ stream within the heater. In addition, the method includes (d) outputting a heated stream from the heater, (e) transferring heat from the heated stream to the separate endothermic process, and (f) heating the carbonaceous fuel with the heated stream, upstream of the heater after (e). Further, the method includes (g) flowing the heated stream to the separator after (f).

Some embodiments disclosed herein are directed to a system for transferring thermal energy to a separate endothermic process. In some embodiments, the system includes a heater including one or more inlets that are configured to receive a carbonaceous fuel and a $CO_2$ stream and an outlet, the heater configured react the carbonaceous fuel with an oxidantin the presence of the $CO_2$ stream to produce a heated stream. In addition, the system includes a heat transfer assembly fluidly coupled to the outlet, the heat transfer assembly configured to transfer heat from the heated stream to the separate endothermic process. Further, the system includes a separator fluidly coupled to and downstream of the heat transfer assembly, the separator configured to separate out the $CO_2$ stream from the heated stream. The separator is further coupled to and upstream of the one or more inlets of the heater such that the $CO_2$ stream is to flow from the separator back toward the one or more inlets of the heater.

Embodiments described herein comprise a combination of features and characteristics. The foregoing has outlined rather broadly the features and technical characteristics of at least some of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the embodiments disclosed herein.

BRIEF DESCRIPTION OF THE DRAWINGS

For a detailed description of various embodiments, reference will now be made to the accompanying drawings in which.

DETAILED DESCRIPTION

Figure 1:
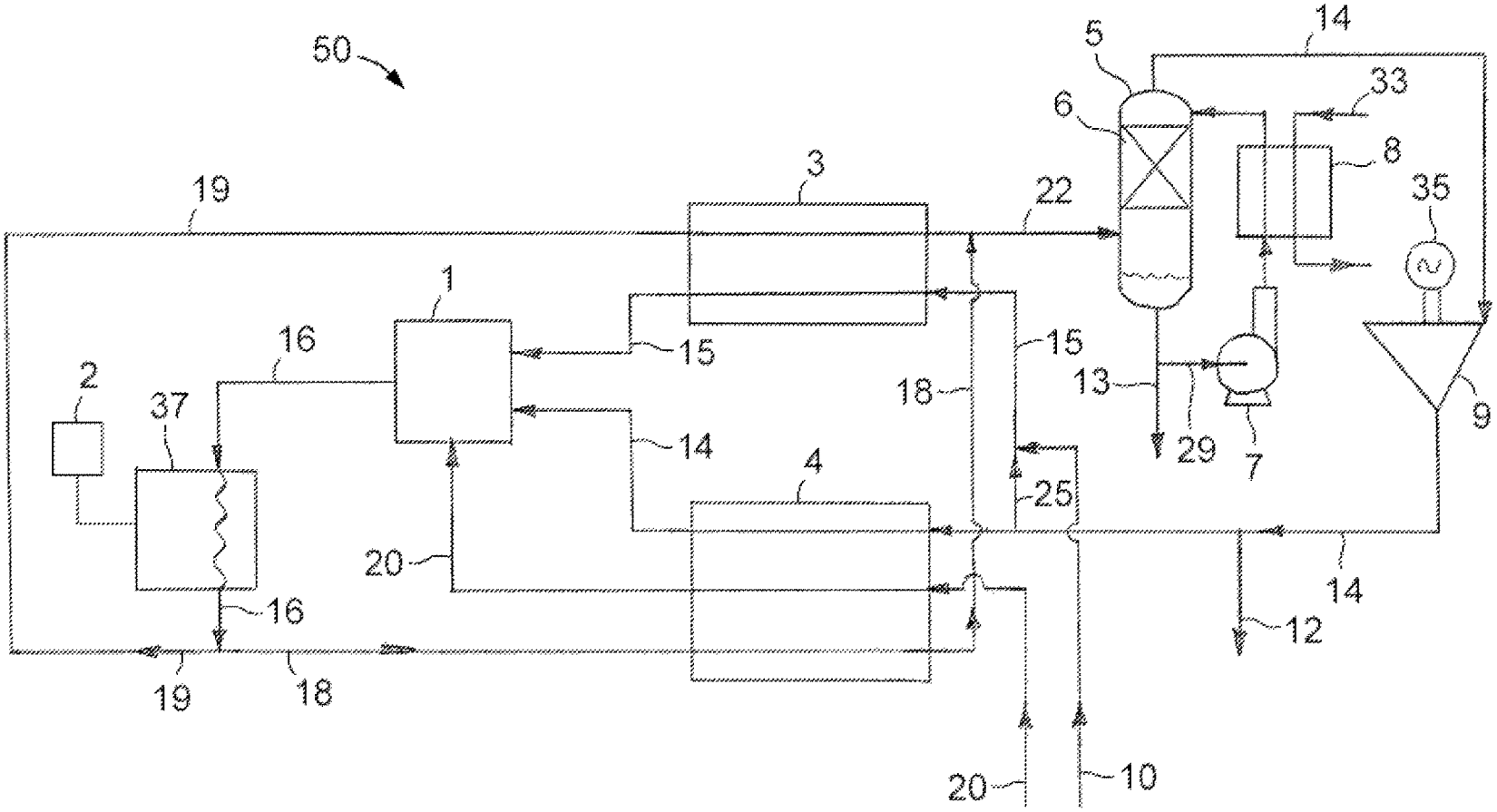
FIG. 1 is a schematic diagram of a system for transferring heat to a separate endothermic process according to some embodiments.

This disclosure is directed to systems and methods for generating and transferring heat to a separate endothermic process while capturing produced $CO_2$. As used herein, a "separate endothermic process" or "separate process" refers to an industrial process (e.g., any of the above-mentioned example industrial endothermic processes) that is separate and independent from the systems and methods for transferring heat described herein. Thus, as described herein, a "separate endothermic process" may receive heat (thermal energy) via the disclosed systems and methods but would otherwise be a separate industrial process wholly apart and independent from the disclosed systems and methods. However, in some embodiments, the "separate endothermic process" may utilize one or more other output streams (e.g., an output $CO_2$ stream, an output water stream, etc.) from the systems disclosed herein.

In some embodiments, a carbonaceous fuel may be reacted with an oxidant in the presence of a circulating stream of $CO_2$ to generate heat that is then transferred via suitable processes and/or components to the separate endothermic process. The carbonaceous fuel may comprise any suitable fuel such as, for instance, a hydrocarbon fuel or a non-hydrocarbon carbonaceous fuel such as carbon monoxide (CO). For example, in some embodiments, the carbonaceous fuel may comprise natural gas or one or more components thereof (e.g., ethane, methane, propane, etc.).

In some embodiments, oxygen ($O_2$) may be used as an oxidant when reacting the carbonaceous fuel. In some embodiments, the oxidant stream provided to the heater may comprise pure or nearly pure $O_2$. For instance, the oxidant stream may comprise between about 95 vol % and about 100 vol % $O_2$. In some embodiments, the oxidant may be diluted with a diluent, such as $CO_2$ or other material that exhibits a suitably low reactivity with the fuel under the operating conditions of the heater (e.g., via the circulating stream) to provide an oxidant stream to the heater with a reduced $O_2$ concentration, including in the range of about 20% to about 30% molar. Without being limited to this or any other theory, diluting the oxidant in this manner may allow for moderation of the adiabatic flame temperature in the heater. In some embodiments, the quantity of $O_2$ fed to the heater may be in excess of that required for complete reaction (e.g., oxidation or actual combustion), thereby leading to an oxygen concentration in the output stream from the heater of about 0.5 vol % to about 10 vol % $O_2$. Without being limited to this or any other theory, providing such an excess quantity of oxygen to the heater may help to ensure complete reaction of the carbonaceous fuel.

The products of reaction of the carbonaceous fuel may comprise $CO_2$ and water ($H_2O$). These products are mixed with the circulating stream of $CO_2$ and are then routed to transfer thermal energy (e.g., heat) to the separate endothermic process. Without being limited to this or any other theory, the circulating stream of $CO_2$ may operate as a working fluid that receives thermal energy from the reaction process and then transfers that thermal energy to the separate endothermic process downstream of the heater. As a result, the circulating stream of $CO_2$ may allow thermal energy to be more efficiently transferred from the reaction process to the separate endothermic process during operations. In addition, any $CO_2$ produced during the reaction process may be integrated into the circulating stream of $CO_2$ so that atmospheric $CO_2$ emissions from the reaction of the carbonaceous fuel may be significantly reduced or even eliminated. Because the circulating stream of $CO_2$ may be utilized as a heat transfer medium with the embodiments disclosed herein, the circulating stream of $CO_2$ may be referred to as a "$CO_2$ work stream."

In some embodiments, the $CO_2$ work stream may be at an elevated pressure. For instance, in some embodiments, the $CO_2$ work stream may be at a pressure from about 30 bar (3 MPa) to about 100 bar (10 MPa). In some embodiments, the $CO_2$ work stream, at the elevated pressure, may deliver heat to a separate endothermic process at temperatures up to about 1000° C. (e.g., via suitable heat exchanger devices and systems) or higher, if materials allow. Thus, in some embodiments, the $CO_2$ work stream may comprise supercritical $CO_2$.

In some embodiments, following heat transfer to the separate endothermic process, additional thermal energy may be transferred from the $CO_2$ work stream (which now includes the products of reaction of the carbonaceous fuel as previously described) to preheat other streams (e.g., the $CO_2$ work stream upstream of the heater, the oxidant, the carbonaceous fuel, etc.) before they enter the heater. In some embodiments, a single heat exchanger or multiple heat exchangers may be used to transfer the additional heat from the $CO_2$ work stream to the other stream(s) as described. For instance, in some embodiments, a first heat exchanger may be used to transfer heat from the $CO_2$ work stream to the carbonaceous fuel, while a second heat exchanger may be used to transfer heat from the $CO_2$ work stream to the oxidant. Without being limited to this or any other theory, by preheating the oxidant and carbonaceous fuel in separate heat exchangers (e.g., the first heat exchanger and the second heat exchanger), one may avoid heating these components in a single heat exchanger, which may pose a risk of unintentional reaction. In some embodiments, the heat exchanger(s) used to preheat one or more streams via the $CO_2$ work stream, following heat transfer to the separate endothermic process, may comprise one or more heat exchangers of any physical configuration (embodiments of which include plate-and-fin heat exchangers, and other heat exchangers suitable for high temperature operation with possibly corrosive materials—e.g., a high nickel allow).

In some embodiments, after transferring heat to the separate endothermic process, the $CO_2$ work stream (including the products of reaction from the heater) may be cooled (e.g., to or near to ambient temperature) so that the $H_2O$ produced in the heater may be separated from the $CO_2$ work stream. Excess or net $CO_2$ may be removed from the process and provided to a separate process or unit. The excess or net $CO_2$ may be removed under pressure control at (or near) ambient temperature. For instance, the net $CO_2$ removed from the $CO_2$ work stream may be at a pressure from about 30 bar (3 MPa) to about 100 bar (10 MPa). In some embodiments, the net $CO_2$ removed from the $CO_2$ work stream may comprise the excess $O_2$ from the heater and additional impurities (e.g., argon, nitrogen, etc.) that may be present in the oxidant stream.

The remaining, $CO_2$ work stream (e.g., following removal of $H_2O$ and the net $CO_2$) may then be recirculated back to the heater to complete the fluid circuit and reinitiate the process described above. In some embodiments, the $CO_2$ work stream may be pressurized to initiate the flow thereof back toward the heater (or the one or more heat exchangers for preheating as previously described). For instance, in some embodiments, the $CO_2$ work stream may be pressurized to a level sufficient to maintain a desired pressure thereof during the processes described above (e.g., from about 30 bar to about 100 bar as previously described). In some embodiments, the $CO_2$ work stream may be enriched with $O_2$ diffused through a semi-permeable barrier (which may or may not be electrostatically charged) from a feed work stream consisting of a reduced mixture of $O_2$ and other gases (including the gases in air and including $CO_2$), at a reduced concentration of $O_2$, including in the range of about 20% to about 30% molar, where the differentials of temperatures and pressures of the feed work stream and of the $CO_2$ work stream drive the enrichment of the $CO_2$ work stream with $O_2$, in a single pass or in multiple passes, all as may or may not be aided by a charge on the semi-permeable barrier.

In some embodiments, the $CO_2$ work stream may be routed to and through a heater in which $O_2$ is diffused through a semi-permeable barrier (one embodiment of which is an oxygen ion transport membrane (ITM)). For instance, in some embodiments, the $CO_2$ work stream may have a pre-heated hydrocarbon vapor added upstream of the ITM heater. An air stream at near atmospheric pressure may be preheated in a heat exchanger (e.g., a recuperator heat exchanger) and then passed through the ITM heater on a first side of the ITM membrane. A fraction of the $O_2$ in the air may then diffuse through the membrane to a second, opposite side of the membrane whereby it reacts with the carbonaceous fuel in the circulating $CO_2$ stream. Within the heater, the $CO_2$ work stream may be heated to a temperature of about 400° C. to about 1000° C. or higher, if materials allow. The depleted air stream emitted from the heater (e.g., on the first side of the membrane) may be cooled (e.g., in the same heat exchanger that is used to preheat the incoming air stream as previously described) and then vented to the atmosphere. The operation of the ITM unit may call for an air inlet temperature above about 800° C. in order for the ITM membrane to be able to rapidly diffuse $O_2$ from the air steam to the carbonaceous fuel laden recycle $CO_2$ stream. With the $CO_2$ outlet from the ITM at about 1000° C., it may be desirable to have about 60 vol % of the $O_2$ in the air stream diffused through the ITM membrane during operations. In addition, the heat exchanger that may be used to both preheat the incoming air stream and cool the outgoing airstream may operate with a cold end temperature difference of about 5° C. to about 15° C. In addition, the heat exchanger may operate with an air inlet temperature above about 800° C. when the air outlet temperature from the ITM above about 925° C.

Referring now to FIG. 1, which shows a non-limiting example of a system 50 for transferring heat to a separate endothermic process 2 according to some embodiments. As previously described, the system 50 may circulate a $CO_2$ working stream 16 to transfer heat to the separate endothermic process 2 via a heat transfer assembly 37.

The system 50 may include a heater 1 that receives an oxidant stream 15, the $CO_2$ work stream 14, and a carbonaceous fuel stream 20. The oxidant stream 15 may be derived from an $O_2$ feed stream 10, which may have a high purity of $O_2$ (e.g., between 95% and 100% molar, such as about 99.5% molar in some embodiments). The $O_2$ feed stream 10 may be supplied from a cryogenic air separation unit or other suitable source. The $O_2$ feed stream 10 may be mixed with a portion of the $CO_2$ work stream (e.g., via 25), upstream of the heater 1 to form oxidant stream 15 such that the oxidant stream 15 may comprise a reduced concentration of $O_2$ as compared to the $O_2$ feed stream 10. For instance, the oxidant stream 15 may comprise approximately 25 vol. % $O_2$ with a balance (e.g., approximately 75 vol. %) being $CO_2$ from the circulating $CO_2$ stream (including other potential impurities).

The carbonaceous fuel stream 20 may comprise any suitable fuel. For instance, in some embodiments, the carbonaceous fuel stream 20 may comprise a hydrocarbon fuel, such as natural gas or one or more components thereof (e.g., ethane, methane, propane, etc.), or a non-hydrocarbon fuel, such as carbon monoxide (CO). In some embodiments, the carbonaceous fuel stream 20 may comprise methane ($CH_4$).

Within the heater 1, the carbonaceous fuel stream 20 is mixed with the oxidant stream 15 and is reacted in the presence of the $CO_2$ work stream 14 so that the products of the reaction (e.g., $CO_2$ and $H_2O$ as previously described) mix with the $CO_2$ work stream 14 and exit the heater 1 as a total heated stream 16. The total heated stream 16 comprises the $CO_2$ work stream 14 and the products of the reaction of the carbonaceous fuel stream 20 and any remnants of oxidant stream 15. The total heated stream 16 may be at an elevated temperature, such as, for instance about 950° C. in some embodiments. In some embodiments, the pressure of the total heated stream 16 may be at an elevated pressure, such as, for instance approximately 50 bar (5 MPa). The total heated stream 16 is then routed to the heat transfer assembly 37 such that the heat (thermal energy) within total heated stream 16 is transferred to the separate endothermic process 2 as previously described.

The heat transfer assembly 37 may comprise any suitable heat transfer component or device, or a collection of such components or devices. In some embodiments, the heat transfer assembly 37 may comprise a heat exchanger or a plurality of heat exchangers. In addition, in some embodiments, the heat transfer assembly 37 may be partially or wholly incorporated within the separate endothermic process 2.

Downstream of the heat transfer assembly 37, the total heated stream 16 is split into a first heated stream 18 and a second heated stream 19. Due to the heat transfer to the separate endothermic process 2 via the heat transfer assembly 37, the temperature of the first heated stream 18 and second heated stream 19 may be less than that of the total heated stream 16 upon its initial exit from the heater 1. However, additional heat may still be recovered from the first heated stream 18 and the second heated stream 19 for use within the system 50. For instance, in some embodiments, the total heated stream 16 (and thus also the first heated stream 18 and the second heated stream 19) may be at a temperature of about 450° C. downstream of the heat transfer assembly 37.

In some embodiments, the first heated stream 18 is routed through a first heat exchanger 4 to pre-heat the carbonaceous fuel stream 20 and the $CO_2$ work stream 14, upstream of the heater 1. In addition, in some embodiments, the second heated stream 19 is routed through a second heat exchanger 3 to pre-heat the oxidant stream 15 upstream of the heater 1. In some embodiments, the carbonaceous fuel stream 20 and the circulating $CO_2$ stream 14 may be heated to about 440° C. at a pressure of about 50 bar (5 MPa) within the first heat exchanger 4, and the oxidant stream 15 may be heated to about 440° C. within the second heat exchanger 3. Because the first heat exchanger 4 and the second heat exchanger 3 recover or recuperate excess heat from the total heated stream 16 following heat transfer to the separate endothermic process 2, the heat exchangers 4,3 may be referred to herein as "recuperator" heat exchangers. In some embodiments, the oxidant stream 15 may enter the second heat exchanger 3 at a temperature of about 25° C., the carbonaceous fuel stream 20 may enter the first heat exchanger 4 at temperature of about 15° C., and the $CO_2$ work stream 14 may enter the first exchanger 4 at a temperature of about 40° C.

In some embodiments, the first heat exchanger 4 and the second heat exchanger 3 may be combined into a single heat exchanger. However, in some embodiments, the first heat exchanger 4 and the second heat exchanger 3 may be separate from one another to avoid heating the carbonaceous fuel stream 20 and the oxidant stream 15 in the same heat exchanger, upstream of the heater 1. Without being limited to this or any other theory, separating the first heat exchanger 4 from the second heat exchanger 3 may reduce the likelihood of an unintentional (and possibly uncontrolled) reaction of the carbonaceous fuel stream 20 and the oxidant stream 15.

After flowing through the heat exchangers 4, 3, the first heated stream 18 and second heated stream 19 may be recombined as a recombined heated stream 22 and routed to a separator or cooler 5 wherein $H_2O$ is separated from $CO_2$ and other constituents in the recombined heated stream 22, thereby producing a supply of water 29. The supply of water 29 (or a portion thereof) may be emitted from the process via a water product stream 13. Alternatively (or additionally) the supply of water 29 (or a portion thereof) may be recycled back into the cooler 5 via a pump 7. The recycled supply of water 29 may first be routed through a heat exchanger 8 such that the recycled supply of water 29 may be cooled via a cooling water stream 33 therein. Thereafter, the cooled, recycled supply of water 29 is emitted back into the cooler 5 wherein the recycled supply of water 29 irrigates a packing 6 positioned within the cooler 5. The incoming recombined heated stream 22 contacts the irrigated packing 6 thereby cooling the recombined heated stream 22 to near ambient temperature. As a result, $H_2O$ is separated out of the recombined heated stream 22 and settles at the bottom of cooler 5 where it is emitted as the supply of water 29 as previously described. Because the recombined heated stream 22 directly contacts the water within the packing 6, the cooler 5 may be referred to herein as a direct contact water cooler.

The remaining $CO_2$ and other constituents are then emitted from cooler 5 as the $CO_2$ work stream 14. In some embodiments the $CO_2$ work stream 14 that is emitted from the cooler 5 may be at a temperature of about 20° C. In addition, in some embodiments, the $CO_2$ work stream 14 that is emitted from cooler 5 may be at a pressure of about 49 bar (4.9 MPa).

Downstream of cooler 5, the $CO_2$ work stream may be pressurized via a blower 9 that is driven by a driver 35 (e.g., electric motor, hydraulic motor, internal combustion engine, turbine, etc.). In some embodiments, the $CO_2$ work stream may be pressurized by the blower 9 to a pressure of about 52 bar (MPa).

Net $CO_2$ produced within the system 50 may be removed from the $CO_2$ work stream 14 via a product stream 12. The product stream 12 may be at a pressure of approximately 52 bar (5.2 MPa) in some embodiments and may be further compressed for delivery to a pipeline or other destination. For instance, in some embodiments, the product stream 12 may be further compressed as a gas to a pressure of about 150 bar (15 MPa) to about 250 bar (25 MPa) or pressurized as a liquid at a pressure of about 6 bar (0.6 MPa). Following removal of the product stream 12, the remaining $CO_2$ work stream 14 is then routed back toward the heater 1 to transfer heat to the separate endothermic process 2 as previously described above.

Thus, operation of the system 50 as described above allows heat to be transferred to a separate endothermic process 2 while capturing all (or substantially all) of the $CO_2$ produced via the reaction within the heater 1. In some embodiments, the system 50 may deliver heat efficiently to the separate endothermic process 2 over a temperature range of about 300° C. to about 1000° C. or higher, if materials allow.

Figure 2:
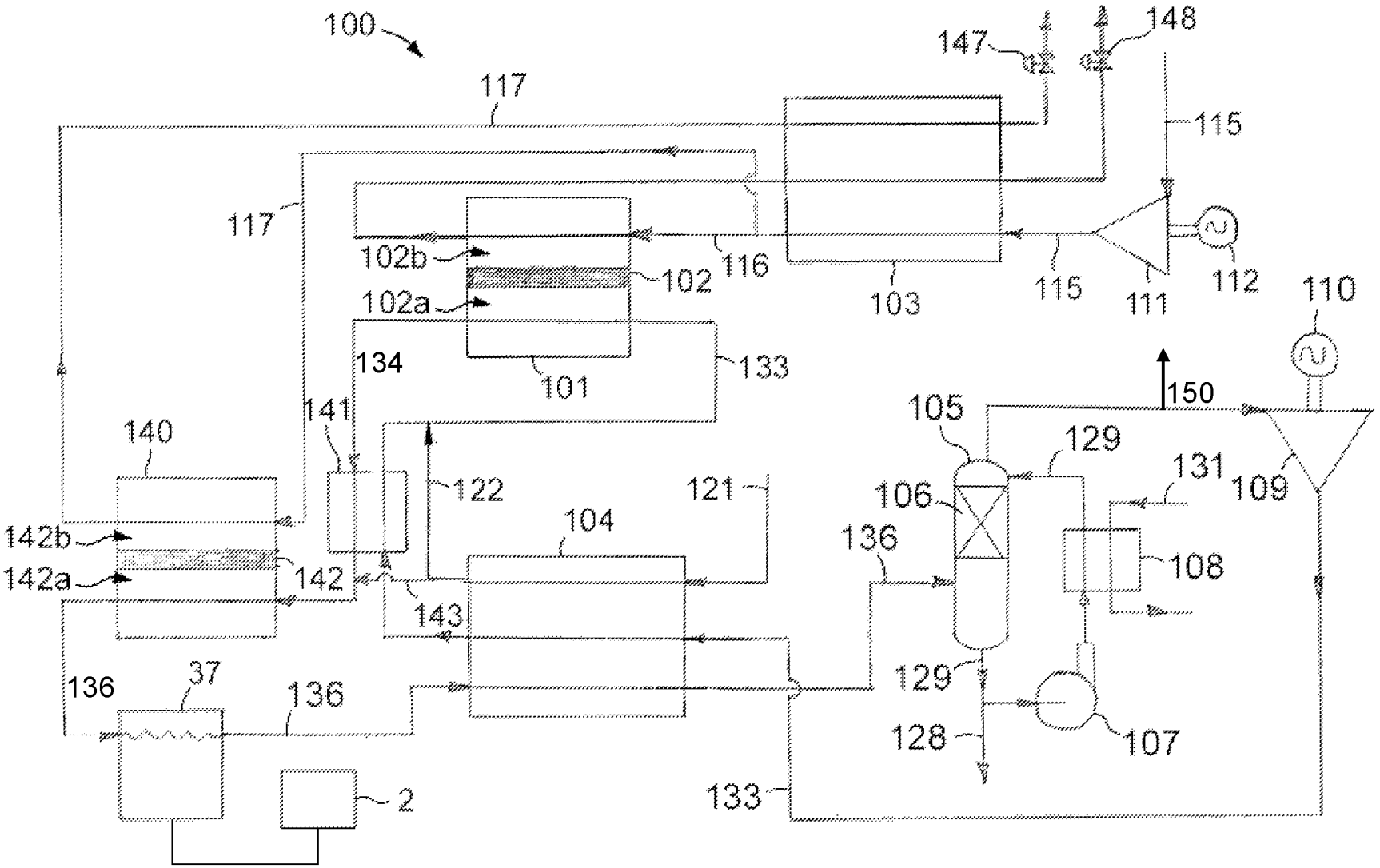
FIG. 2 is a schematic diagram of another system for transferring heat to a separate endothermic process according to some embodiments.

Referring now to FIG. 2, which shows a non-limiting example of another system 100 for transferring heat to a separate endothermic process 2 according to some embodiments. As previously described, the system 100 may circulate a $CO_2$ work stream 133 to transfer thermal energy to the separate endothermic process 2 via a heat transfer assembly 37.

The system 100 includes a first heater 101 and a second heater 140 operating in series. In some embodiments, the first heater 101 and the second heater 140 may each comprise oxygen ITM heaters that include membranes 102 and 142, respectively, that are configured to diffuse $O_2$ therethrough. The first heater 101 and second heater 140 may receive inputs derived from the $CO_2$ work stream 133, a carbonaceous fuel stream 121, and an oxidant stream 115 as described in more detail below.

The oxidant stream 115 may comprise air that is compressed via a compressor 111 that is driven by a driver 112 (e.g., electric motor, hydraulic motor, internal combustion engine, turbine, etc.). In some embodiments, the compressor 111 may compress the oxidant stream 115 to about 1.3 bar (0.13 MPa). After being output by the compressor 111, the oxidant stream 115 is split such that a first portion 116 of the oxidant stream 115 is routed to the first heater 101 and a second portion 117 of the oxidant stream 115 is routed to the second heater 140. The amount or flow of air to the first heater 101 and second heater 140 via the first portion 116 and second portion 117, respectively, of the oxidant stream 115 may be controlled via a pair of control valves 147 and 148, respectively, positioned downstream of the first heater 101 and the second heater 140.

The carbonaceous fuel stream 121 may comprise any suitable fuel. For instance, in some embodiments, the carbonaceous fuel stream 121 may comprise a hydrocarbon fuel, such as natural gas or one or more components thereof (e.g., ethane, methane, propane, etc.), or a non-hydrocarbon fuel such as carbon monoxide (CO). In some embodiments, the carbonaceous fuel stream 121 may comprise methane ($CH_4$). The carbonaceous fuel stream 121 is split into a first portion 122 and a second portion 143. The first portion 122 of the carbonaceous fuel stream 121 is routed toward the first heater 101, and the second portion 143 of the carbonaceous fuel stream 121 is routed toward the second heater 140. Further details of how the first portion 122 and the second portion 143 of the carbonaceous fuel stream 121 are flowed into the first heater 101 and the second heater 140, respectively, are provided below.

The $CO_2$ work stream 133 is initially flowed into the first heater 101. Specifically, the first portion 122 of the carbonaceous fuel stream 121 is mixed with the $CO_2$ work stream and the mixture is then routed into the first heater 101. Within the first heater 101, the mixture of the circulating $CO_2$ stream 133 and the first portion 122 of the carbonaceous fuel stream 121 are passed along a first side **102*a* of the membrane 102 and the first portion 116 of the oxidant stream 115 is passed along a second side 102*b* of the membrane 102. As shown in FIG. 2, the first side 102*a* is opposite the second side 102*b*. The $O_2$ (or at least some of the $O_2$) within the first portion of the oxidant stream 115 is diffused across the membrane 102 from the second side 102*b* to the first side 102*a* such that the $O_2$ mixes with the carbonaceous fuel and is reacted in the presence of the $CO_2$ work stream to thereby form a first heated stream 134 that is output from the first heater 101. In some embodiments, 60 vol % of the $O_2$ in the first portion 116 of the oxidant stream 115 diffuses across the membrane within the first heater 101. The first heated stream 134 includes the $CO_2$ work stream and the products of reaction from the first heater 101 (which may comprise $CO_2$ and $H_2O$ as previously described). In some embodiments, the first heated stream 134** may be at a temperature of about 1020° C.

The heated stream 134 is then passed through a heat exchanger 141 so that heat may be transferred to the $CO_2$ work stream 133 prior to the mixing of the $CO_2$ work stream 133 and the first portion 122 of the carbonaceous fuel stream 121 upstream of the first heater 101. In some embodiments, the mixing point of the first portion 122 of the carbonaceous fuel stream 121 and the $CO_2$ work stream 133 may be relatively close to the outlet heat exchanger 141 so as to avoid significant $CH_4$ cracking or $CH_4$ plus $CO_2$ reforming upstream of the first heater 101. In some embodiments, the first heated stream 134 may exit the heat exchanger 141 at a temperature of about 800° C.

After being output from the heat exchanger 141, the heated stream 134 is mixed with the second portion 143 of the carbonaceous fuel stream 121, and the mixture is then routed into the second heater 140. Within the second heater 140, the mixture of the first heated stream 134 and the second portion 143 of the carbonaceous fuel stream 121 are passed along a first side 142*a* of the membrane 142 and the second portion 117 of the oxidant stream 115 is passed along a second side 142*b* of the membrane 142. The first side 142*a* is opposite the second side 142*b*. The $O_2$ (or at least some of the $O_2$) within the second portion 117 of the oxidant stream 115 is diffused across the membrane 142 from the second side 142*b* to the first side 142*a* such that the $O_2$ mixes with the carbonaceous fuel and is reacted in the presence of the $CO_2$ within the first heated stream 134 to thereby form a second heated stream 136 that is output from the second heater 140. In some embodiments, 60 vol % of the $O_2$ in the second portion 117 of the oxidant stream 115 diffuses across the membrane within the second heater 140. The second heated stream 136 includes the $CO_2$ work stream 133 and the products of reaction from both the first heater 101 and the second heater 140 (which may comprise $CO_2$ and $H_2O$ as previously described).

The second heated stream 136 may be at an elevated temperature, such as, for instance about 1000° C. in some embodiments. In some embodiments, the pressure of the second heated stream 136 may be approximately 50 bar (5 MPa) (e.g., 51.5 bar or 5.15 MPa). The second heated stream 136 is then routed to the heat transfer assembly 37 such that heat within second heated stream 136 is transferred to the separate endothermic process 2 as previously described.

Due to the heat transfer to the separate endothermic process 2 via the heat transfer assembly 37, the temperature of the second heated stream 136 may be reduced as it flows through the one or more heat transfer components 37. However, additional heat may still be recovered from the second heated stream 136 for use within the system 100. For instance, in some embodiments, the second heated stream 136 may be at a temperature of about 450° C. after being output from the heat transfer assembly 37. In addition, in some embodiments, the second heated stream 136 may be at a pressure of about 49.5 bar (4.95 MPa) after being output from the heat transfer assembly 37.

In some embodiments, the second heated stream 136 is routed through a first heat exchanger 104 to pre-heat the carbonaceous fuel stream 121 and the $CO_2$ work stream 133, upstream of the heater 1. In some embodiments, the carbonaceous fuel stream 121 and the $CO_2$ work stream 133 may be heated to a temperature of about 440° C. at a pressure of about 52 bar (5.2 MPa) within the first heat exchanger 104. Because the first heat exchanger 104 recovers or recuperates excess heat from the second heated stream 136 following thermal heat transfer to the separate endothermic process 2, the heat exchanger 104 may be referred to herein as a "recuperator" heat exchanger. In some embodiments, the carbonaceous fuel stream 121 may enter the first heat exchanger 104 at temperature of about 15° C., and the $CO_2$ work stream 133 may enter the first exchanger 104 at a temperature of about 40° C. Upon exiting the first heat exchanger 104, the $CO_2$ work stream 133 is then routed through the heat exchanger 141 as previously described, such that the $CO_2$ work stream 133 is further heated to a temperature of about 800° C.

In addition, the first portion 116 and the second portion 117 of the oxidant stream 115 are heated within the first heater 101 and the second heater 140, respectively. Thus, after the first portion 116 and the second portion 117 are emitted from the first heater 101 and the second heater 140, respectively, they are routed through a second heat exchanger 103 to preheat the oxidant stream 115 upstream of the first heater 101 and the second heater 140. Because the second heat exchanger 103 recovers or recuperates excess heat from the first portion 116 and second portion 117 of the oxidant stream 115, the heat exchanger 103 may be referred to herein as a "recuperator" heat exchanger. In some embodiments, the oxidant stream 115 may enter the second heat exchanger 103 at a temperature of about 40° C., and may exit the second heat exchanger 103 at a temperature of about 850° C. (e.g., 848° C.).

In some embodiments, the first heat exchanger 104 and the second heat exchanger 103 may be combined into a single heat exchanger. However, in some embodiments, the first heat exchanger 104 and the second heat exchanger 103 may be separate from one another to avoid heating the carbonaceous fuel stream 121 and the oxidant stream 115 (or the first portion 116 or second portion 117 thereof) in the same heat exchanger, upstream of the first heater 101 and second heater 140. Thus, separating the first heat exchanger 104 from the second heat exchanger 103 may reduce the likelihood of an unintentional (and possibly uncontrolled) reaction of the carbonaceous fuel stream 121 and the oxidant stream 115.

In some embodiments, within the first heat exchanger 104, the first heated stream 136 may be cooled to a temperature of about 50° C. After flowing through the first heat exchanger 104, the first heated stream 136 is routed to a separator or cooler 105 wherein $H_2O$ is separated from $CO_2$ and other constituents in the second heated stream 136, thereby producing a supply of water 129. The supply of water 129 (or a portion thereof) may be emitted from the process via a water product stream 128. Alternatively (or additionally) the supply of water 129 (or a portion thereof) may be recycled back into the cooler 105 via a pump 107. The recycled supply of water 129 may first be routed through a heat exchanger 108 such that the recycled supply of water 129 may be cooled via a cooling water stream 131 therein. In some embodiments, the cooling water 131 may enter the heat exchanger 108 at a temperature of about 20° C., and may exit the heat exchanger 108 at a temperature of about 30° C. Thereafter, the cooled, recycled supply of water 129 is emitted back into the cooler 105 wherein the recycled supply of water 129 irrigates a packing 106 positioned within the cooler 105. In some embodiments, the supply of water 129 may be cooled to a temperature of about 25° C. within the heat exchanger 108 before recycling back into the cooler 105. The incoming second heated stream 136 contacts the irrigated packing 106 thereby cooling the second heated stream 136 to near ambient temperature. As a result, water is separated out of the second heated stream 136 and settles at the bottom of cooler 105 where it is emitted as the supply of water 129 as previously described. Because the heated stream 136 directly contacts the water within the packing 106, the cooler 105 may be referred to herein as a direct contact water cooler.

The remaining $CO_2$ and other constituents are then emitted from cooler 105 as the $CO_2$ work stream 133. In some embodiments the $CO_2$ work stream 133 that is emitted from the cooler 105 may be at a temperature of about 20° C. In addition, in some embodiments, the $CO_2$ work stream 133 that is emitted from cooler 105 may be at a pressure of about 49 bar (4.9 MPa).

Downstream of cooler 105, the $CO_2$ work stream 133 may be pressurized via a blower 109 that is driven by a driver 110 (e.g., electric motor, hydraulic motor, internal combustion engine, turbine, etc.). In some embodiments, the $CO_2$ work stream 133 may be pressurized by the blower 109 to a pressure of about 52 bar (MPa). Net $CO_2$ produced within the system 100 may be removed from the $CO_2$ work stream 14 via a product stream 150 in a similar manner described above for product stream 12 (FIG. 1). Following pressurization via the blower 109 and removal of the net $CO_2$ as previously described, the $CO_2$ work stream 133 is then routed back toward the heaters 101,140 to transfer heat to the separate endothermic process 2 as previously described above.

Thus, operation of the system 100 as described above allows heat (thermal energy) to be transferred to a separate endothermic process 2 while capturing all (or substantially all) of the $CO_2$ produced via the reaction within the heaters 101, 140. In some embodiments, the system 100 may deliver heat efficiently to the separate endothermic process over a temperature range of about 300° C. to about 1000° C.

As described above, the embodiments disclosed herein are directed to systems and methods for generating thermal energy to drive or power an endothermic process while also capturing carbon (e.g., in the form of $CO_2$) that is produced to reduce net carbon emissions during operations. In some embodiments, the systems and methods described herein may be utilized to capture carbon that is produced from the reaction of a carbonaceous fuel, such as a hydrocarbon or carbon monoxide. Thus, through use of the embodiments disclosed herein, thermal energy may be provided to an endothermic process without a corresponding increase in the output of $CO_2$ to the atmosphere The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, when used herein (including in the claims), the words "about," "generally," "substantially," "approximately," and the like, when used in reference to a stated value mean within a range of plus or minus 10% of the stated value.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method of transferring thermal energy to a separate endothermic process, the method comprising:

(a) providing a carbon dioxide ($CO_2$) stream and a carbonaceous fuel to a heater;

(b) reacting the carbonaceous fuel with an oxidantin the heater to produce a heated stream;

(c) transferring heat from the heated stream to the separate endothermic process;

(d) separating the $CO_2$ stream from the heated stream after (c); and (e) recycling the $CO_2$ stream to the heater after (d).

2. The method of claim 1, further comprising transferring heat from the heated stream to the $CO_2$ stream and the carbonaceous fuel.

3. The method of claim 2, wherein separating the $CO_2$ stream from the heated stream comprises cooling the heated stream.

4. The method of claim 3, wherein cooling the heated stream comprises contacting the heated stream with water.

5. The method of claim 4, wherein contacting the heated stream with water comprises:

separating a supply of water from the heated stream; and contacting the heated stream with the supply of water.

6. The method of claim 2, further comprising:

providing an oxidant to the heater; and transferring heat from the heated stream to the oxidant.

7. The method of claim 2, wherein the heater comprises an oxygen ion transport membrane heater, and wherein the method further comprises:

receiving an air stream in the heater, the air stream comprising an oxidant; and exposing the carbonaceous fuel to the oxidant within the heater.

8. The method of claim 7, wherein the heater includes a membrane, and wherein the method further comprises:

passing the carbonaceous fuel and the $CO_2$ stream on a first side of the membrane;

passing the air stream on a second side of the membrane, the second side being opposite the first side; and diffusing oxygen from the air stream across the membrane from the second side to the first side.

9. A system for transferring thermal energy to a separate endothermic process, comprising:

a heater including one or more inlets that are configured to receive a carbonaceous fuel, an oxidant, and a carbon dioxide ($CO_2$) stream, and also including an outlet, the heater configured to react the carbonaceous fuel with the oxidant in the presence of the $CO_2$ stream to produce a heated stream;

a heat transfer assembly fluidly coupled to the outlet, the heat transfer assembly configured to transfer heat from the heated stream to the separate endothermic process;

a separator fluidly coupled to and downstream of the heat transfer assembly, the separator configured to separate out the $CO_2$ stream from the heated stream, wherein the separator is further coupled to and upstream of the one or more inlets of the heater such that the $CO_2$ stream is to flow from the separator back toward the one or more inlets of the heater.

10. The system of claim 9, further comprising a heat exchanger fluidly coupled between the heat transfer assembly and the separator, wherein the heat exchanger is configured to transfer heat from the heated stream to the $CO_2$ stream and the carbonaceous fuel.

11. The system of claim 10, wherein the separator comprises a direct contact water cooler.

12. The system of claim 11, wherein the separator comprises:

a second outlet that is configured to receive a supply of water that is separated from the heated stream within the separator; and an inlet that is fluidly coupled to the second outlet that is configured to direct the supply of water back into the separator to contact the heated stream.

13. The system of claim 10, wherein the one or more inlets of the heater are configured to receive an oxidant stream; and wherein the system further comprises:

a second heat exchanger that is configured to heat the oxidant upstream of the heater.

14. The system of claim 13, wherein the heated stream is fluidly coupled to the second heat exchanger such that the second heat exchanger is configured to transfer heat from the heated stream to the oxidant stream.

15. The system of claim 10, wherein the heater comprises an oxygen ion transport membrane heater including a membrane, wherein the heater is configured to pass the carbonaceous fuel and the $CO_2$ stream on a first side of the membrane and is configured to pass an air stream on a second side of the membrane, the second side being opposite the first side.

16. A method of generating thermal energy for a separate endothermic process, the method comprising:

(a) producing a $CO_2$ stream from a first outlet of a separator;

(b) flowing the $CO_2$ stream to a heater;

(c) reacting a carbonaceous fuel with an oxidant in the presence of the $CO_2$ stream within the heater;

(d) outputting a heated stream from the heater;

(e) transferring heat from the heated stream to the separate endothermic process;

(f) heating the carbonaceous fuel with the heated stream, upstream of the heater after (e); and (g) flowing the heated stream to the separator after (f).

17. The method of claim 16, comprising:

separating out a supply of water from the heated stream within the separator; and recycling the supply of water back into the separator.

18. The method of claim 17, comprising contacting the heated stream with the supply of water.

19. The method of claim 18, wherein the heater comprises an oxygen ion transport membrane heater including a membrane, and wherein the method further comprises:

passing the carbonaceous fuel and the $CO_2$ stream on a first side of the membrane;

passing an air stream on a second side of the membrane, the second side being opposite the first side; and diffusing oxygen from the air stream across the membrane from the second side to the first side.

20. The method of claim 18, further comprising:

providing an oxidant to the heater; and transferring heat from the heated stream to the oxidant upstream of the heater.

* * * * *